US006807955B2

(12) United States Patent
Leedham et al.

(10) Patent No.: US 6,807,955 B2
(45) Date of Patent: Oct. 26, 2004

(54) EXHAUST GAS COOLER WITH BYPASS TUBE AND EXHAUST GAS RECIRCULATION VALVE

(75) Inventors: Stewart William Leedham, Nuncaton (GB); Matthew Thomas Graham Stonehouse, Coventry (GB)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 10/332,418

(22) PCT Filed: Jul. 30, 2001

(86) PCT No.: PCT/GB01/03426

§ 371 (c)(1),
(2), (4) Date: Jan. 6, 2003

(87) PCT Pub. No.: WO02/10574

PCT Pub. Date: Feb. 7, 2002

(65) Prior Publication Data

US 2003/0150434 A1 Aug. 14, 2003

(51) Int. Cl.[7] ..... F02M 25/07
(52) U.S. Cl. ..... 123/568.12
(58) Field of Search ..... 123/568.12; 60/288, 60/320, 321

(56) References Cited

U.S. PATENT DOCUMENTS 5,617,726 A * 4/1997 Sheridan et al. ..... 60/605.2
5,732,688 A * 3/1998 Charlton et al. ..... 123/568.12
6,141,961 A 11/2000 Rinckel
6,213,105 B1 * 4/2001 Banzhaf et al. ..... 123/568.12
6,647,971 B2 * 11/2003 Vaughan et al. ..... 123/568.12

FOREIGN PATENT DOCUMENTS

| | | | |
|---|---|---|---|
| DE | 29714478 | 8/1997 | |
| DE | 19733964 A1 * | 2/1999 | ..... F02M/25/07 |
| EP | 0942156 | 9/1999 | |
| EP | 0987427 | 3/2000 | |
| EP | 1030050 | 8/2000 | |

* cited by examiner

*Primary Examiner*—Henry C. Yuen
*Assistant Examiner*—Arnold Castro
(74) *Attorney, Agent, or Firm*—Ephraim Starr; John Christopher James

(57) ABSTRACT

An exhaust gas recirculation cooler (1) with a coolant chamber (14), a bypass tube (50) and means (70) to selectively direct exhaust gas through the coolant chamber (14) or bypass tube (50). The bypass tube (50) may be used to direct hot exhaust gases to the engine under low engine temperature/load operating conditions and during start up of the engine; the coolant chamber (14) may be used to cool very hot gases under high engine temperature/load conditions and direct the cooled gas to the engine. The bypass tube (50) is integrally formed with the coolant chamber, reducing space required for the cooler and making for easier installation.

17 Claims, 2 Drawing Sheets

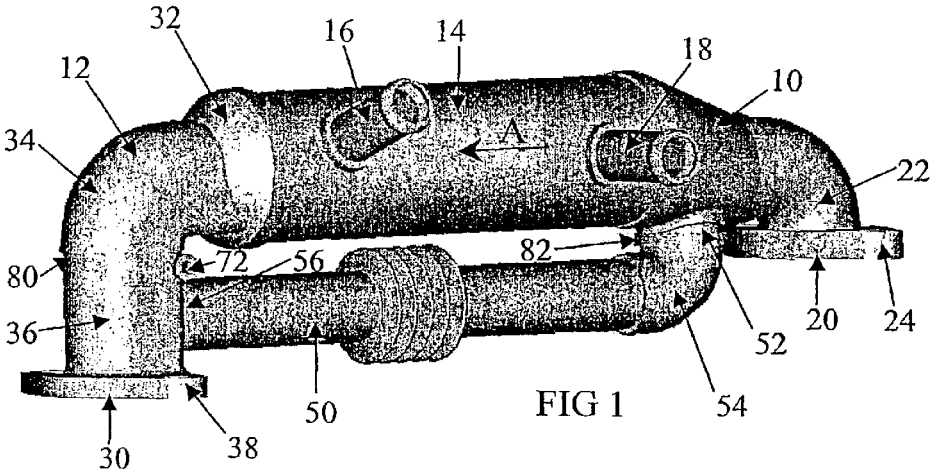
FIG 1
FIG 2
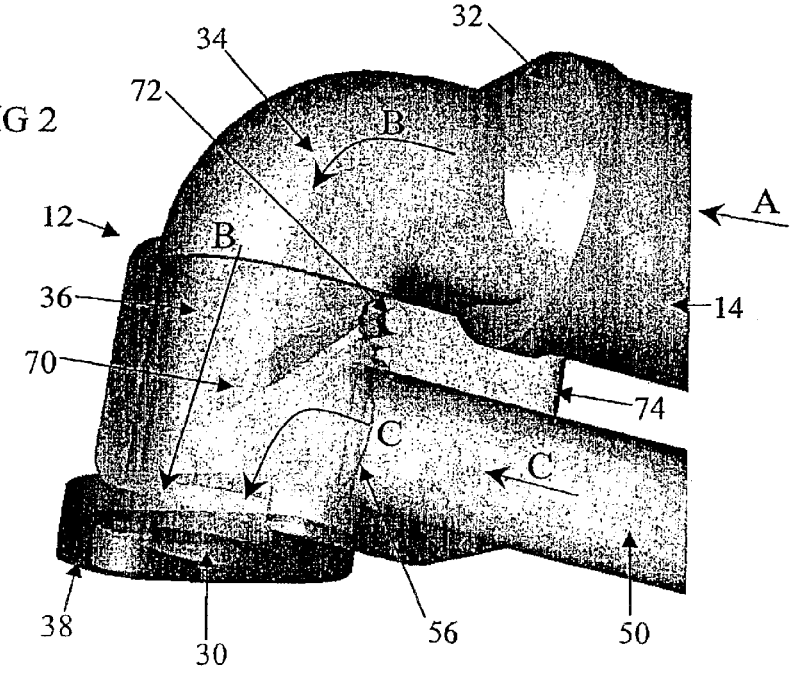

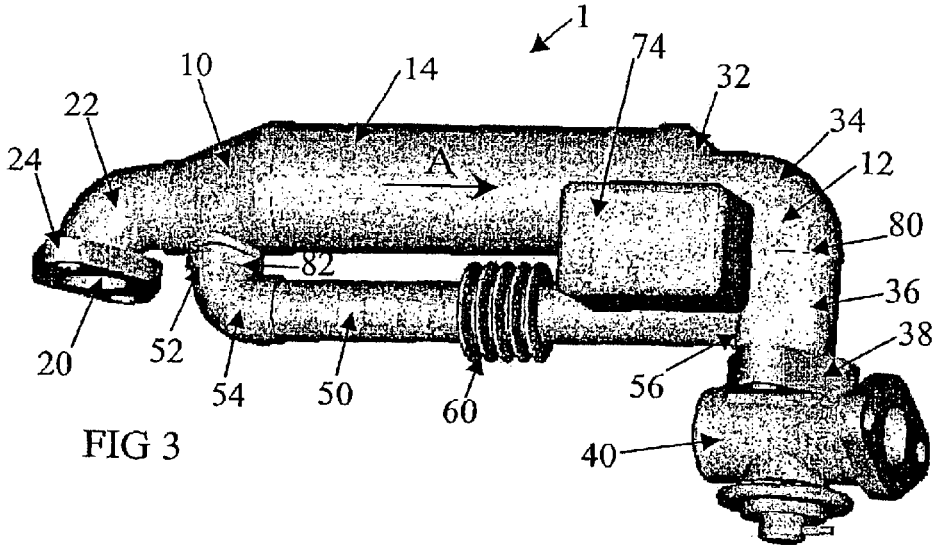
FIG 3
FIG 4
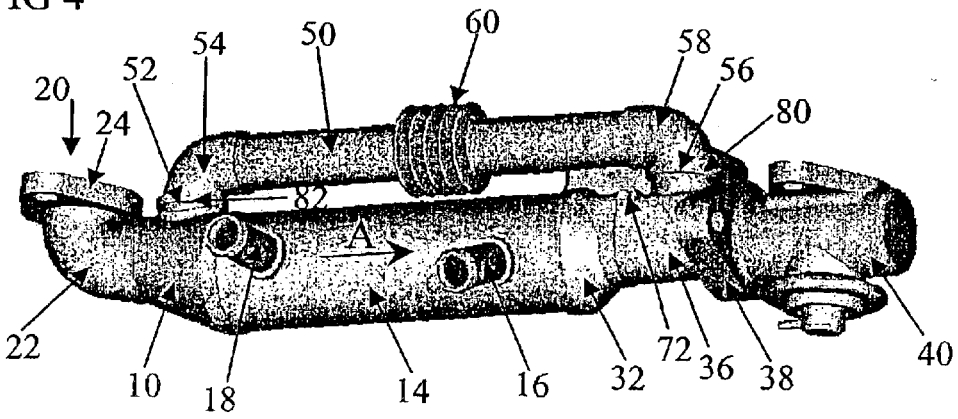

EXHAUST GAS COOLER WITH BYPASS TUBE AND EXHAUST GAS RECIRCULATION VALVE

FIELD OF THE INVENTION

The present invention relates to a cooler for use in an exhaust gas recirculation (EGR) system in an internal combustion engine. In particular the invention relates to an exhaust gas cooler which has a bypass line allowing exhaust gases to either pass through the cooler, thereby being cooled, or pass through the bypass line, thereby avoiding cooling.

BACKGROUND OF THE INVENTION

EGR systems recirculate at least a portion of the engine exhaust gases into the engine air intake system for the purpose of reducing NOx emissions. There is a general requirement to lower vehicular exhaust emissions, including NOx, even further in the light of strict environmental controls. British Patent No 2,303,177 discloses an EGR system in which a portion of the exhaust gases produced by an engine are recirculated from an exhaust line of the engine into an intake line of the engine. In this system a cooler is arranged to cool the recirculated portion of the exhaust gases, and a bypass line is arranged to bypass the cooler. A valve directs the recirculated portion of the exhaust gases to the intake line via the bypass line under low engine temperature and/or load operating conditions, in order to supply hot exhaust gases to the engine under low temperature conditions and during start-up of the engine in order to reduce condensation in the piping and cooler. However British Patent No 2,303,177 does not disclose how the cooler, bypass line and valves are arranged. The cooler and bypass line are provided as separate components, adding to the number of components which must be placed within the limited engine space.

SUMMARY OF THE INVENTION

It is an advantage of the present invention to provide a compact EGR system including an EGR cooler and bypass line, which can be fitted readily into an engine compartment.

According to the present invention there is provided an exhaust gas cooler comprising:

- an exhaust gas inlet chamber communicating with an exhaust gas inlet,
- an exhaust gas outlet chamber communicating with an exhaust gas outlet,
- a coolant chamber arranged between said exhaust gas inlet chamber and said exhaust gas outlet chamber and having a coolant inlet and a coolant outlet communicating with the coolant chamber,
- a plurality of exhaust gas passages inside the coolant chamber and communicating with the exhaust gas inlet chamber and exhaust gas outlet chamber, and
- a means to attach a bypass passage outside the coolant chamber to communicate with the exhaust gas inlet chamber and exhaust gas outlet chamber.

Preferably, the means to attach the bypass passage is integrally formed with the exhaust gas inlet chamber and the exhaust gas outlet chamber.

Preferably, the exhaust gas cooler further comprises a valve assembly arranged at at least one of the exhaust gas inlet chamber and the exhaust gas outlet chamber, the valve assembly being adapted to direct exhaust gas flow through the exhaust gas passages or the means to attach the bypass passage.

Preferably, the valve assembly is arranged at the exhaust gas outlet chamber.

Preferably, the coolant chamber is a tubular chamber and is arranged axially parallel to the bypass passage.

Preferably, the means to attach a bypass passage communicates with the exhaust gas inlet chamber by means of a bypass inlet arranged substantially perpendicular to the direction of flow of exhaust gas through the exhaust gas inlet chamber to the coolant chamber. The means to attach a bypass passage or the bypass passage may comprise an elbow adjacent to the bypass inlet so that the bypass inlet is substantially perpendicular to the axis of the bypass passage when it is attached. Alternatively the exhaust gas inlet chamber may comprise an elbow portion between the coolant chamber and the bypass inlet.

Preferably, the means to attach a bypass passage communicates with the exhaust gas outlet chamber by means of a bypass outlet arranged substantially perpendicular to the direction of flow of exhaust gas through the exhaust gas outlet chamber from the coolant chamber. The exhaust gas outlet chamber may comprise an elbow portion between the coolant chamber and the bypass outlet. Alternatively the means to attach the bypass passage or the bypass passage itself may comprise an elbow adjacent to the bypass outlet so that the bypass outlet is substantially perpendicular to the axis of the bypass passage when it is attached.

Preferably, the valve assembly comprises a valve arranged within the exhaust gas outlet chamber. Preferably, the valve assembly further comprises a motor adapted to drive the valve between an open position in which the valve covers the bypass outlet leaving the exhaust gas outlet chamber open and a closed position in which the valve closes the exhaust gas outlet chamber. The motor may be an electric motor.

Preferably, the bypass passage is formed integrally with the exhaust gas inlet chamber, the exhaust gas outlet chamber and the coolant chamber.

Preferably, the bypass passage includes an expansion means to permit differential thermal expansion of the bypass passage and coolant chamber. Preferably, the bypass passage includes a damping means to assist in vibrational damping of the bypass passage.

The exhaust gas cooler may be provided without a bypass passage and the bypass passage is retro-fitted before use.

Preferably, the exhaust gas passages are exhaust gas tubes. Preferably, the bypass passage is a bypass tube.

BRIEF DESCRIPTION OF THE DRAWINGS

Embodiments of the present invention will now be described, by way of example only, with reference to the accompanying drawings, in which:

FIG. 1 is a perspective view of an EGR cooler in accordance with the present invention;

FIG. 2 is a partial cut-away view of the outlet exhaust gas chamber of the EGR cooler of FIG. 1;

FIG. 3 is a perspective view of the rear of the EGR cooler of FIG. 1; and FIG. 4 is a perspective view of another EGR cooler in accordance with the present invention.

DETAILED DISCUSSION OF THE PREFERRED EMBODIMENT

With reference to FIGS. 1 to 3, there is shown an exhaust gas cooler 1, at a first end of which there is an exhaust gas inlet chamber 10 opening to an exhaust gas inlet 20. The inlet 20 is linked to the chamber 10 by an elbow pipe 22. The chamber 10 tapers in cross-section from its first end, where it connects to the coolant chamber 14, to its second end, where it connects to the elbow pipe 22. The elbow pipe 22 has a flange 24 provided at the inlet 20 for connection to an exhaust pipe or exhaust. manifold (not shown).

At the second end of the exhaust gas cooler 1 there is an exhaust gas outlet chamber 12 opening to an exhaust gas outlet 30. The exhaust gas outlet chamber 12 comprises a first tapering portion 32 which tapers in cross-section from its first end, where it connects to the coolant chamber 14, to its second end, where it forms a second elbow portion 34. The second elbow portion 34 is connected at its other end to a third straight tubular portion 36 of the exhaust gas outlet chamber 12. The outlet 30 is provided at the free end of the straight tubular portion 36, which has a flange 38 provided at the inlet 30 for connection to an exhaust pipe (not shown), or to an EGR valve 40 as shown in FIG. 3. An EGR valve is known in the art and is not described further here.

The coolant chamber 14 is arranged between the exhaust gas inlet chamber 10 and the exhaust gas outlet chamber 12, and is of a known type, having internal tube plates (not shown) at each end, the tube plates being linked by a number of exhaust gas tubes (not shown) which communicate with both the exhaust gas inlet and outlet chambers 10, 12. The coolant chamber 14 has a coolant outlet 16 and a coolant inlet 18 which communicate with the coolant chamber 14. Exhaust gas passes through the exhaust gas tubes in the direction of Arrow A, while coolant fluid such as water flows in substantially the same direction from the inlet 18 to the outlet 16. The coolant circulates around the outside of the exhaust gas tubes, thereby cooling the exhaust gas while the coolant is heated.

In alternative embodiments, plates (not shown) forming passages instead of tubes can be provided in the coolant chamber 14 between the exhaust gas inlet chamber 10 and the exhaust gas outlet chamber 12.

A bypass tube 50 is arranged outside the coolant chamber and communicates with both the exhaust gas inlet chamber 12 and the third straight tubular portion 36 of the exhaust gas outlet chamber 12. The bypass tube 50 is preferably integrally formed with the exhaust gas inlet chamber 10, the exhaust gas outlet chamber 12 and the coolant chamber 14, so that the entire cooler 1 is supplied as a single unit complete with bypass tube 50. The bypass tube 50 extends axially parallel to the coolant chamber 14 and to the exhaust gas tubes arranged within the coolant chamber 14.

In alternative embodiments the exhaust gas cooler 1 may be provided without a bypass tube 50. In such embodiments the bypass tube 50 is retro-fitted before use.

The bypass tube 50 is connected at the inlet end to the exhaust gas inlet chamber 10 by means of a bypass inlet 52 arranged substantially perpendicular to the direction of flow of exhaust gas through the exhaust gas inlet chamber 10 to the coolant chamber 14. In the embodiment of FIGS. 1 to 3 the bypass tube 50 has a right angled elbow piece 54 adjacent to the bypass inlet 52, and the bypass inlet 52 is connected to the tapering portion of the exhaust gas inlet chamber 10. However it is to be understood that the inlet may be similar to the outlet of the illustrated embodiment of FIG. 1, with the exhaust gas inlet chamber 10 comprising an elbow portion (not shown) between the coolant chamber 14 and the bypass inlet 52, so that the bypass tube 50 can connect directly to the exhaust gas inlet chamber 10 without the need for an elbow piece 54.

The bypass tube 50 is connected at the outlet end to the third straight tubular portion 36 of the exhaust gas outlet chamber 12 by means of a bypass outlet 56 arranged substantially perpendicular to the direction of flow of exhaust gas through the exhaust gas outlet chamber 12. In the embodiment of FIGS. 1 to 3 the bypass tube 50 connects directly to the straight tubular section 36 of the exhaust gas outlet chamber 12. However, the bypass tube may comprise a right angled elbow piece 58, as shown in the embodiment of FIG. 4, so that there is no need to provide an elbow 34 in the exhaust gas outlet chamber 12. In this case the exhaust gas outlet chamber 12 comprises a tapering tubular section 32 and a straight tubular section 36, with no elbow section 34.

The bypass tube 50 has an expansion means 60 in order to permit differential thermal expansion of the bypass tube and coolant chamber. Under operating conditions the coolant chamber 14 will be at approximately the same temperature as the coolant, typically approximately 100° C., while the bypass tube 50 can reach temperatures of several hundred ° C. The expansion means 60 can also act as a vibrational damping device.

A valve assembly is provided at the exhaust gas outlet chamber 12 in order to direct exhaust gas flow either through the exhaust gas tubes or through the bypass tube 50. The valve assembly comprises a flap valve 70 located inside the exhaust gas outlet chamber 12. The flap valve is fixedly mounted on a shaft 72, which is driven by a motor 74 secured outside the exhaust gas outlet chamber 12. The motor is controlled so as to cause the flap valve 70 to move between an open position and a closed position. In the open position the valve 70 covers the bypass outlet 56 leaving the exhaust gas outlet chamber 12 open and allowing exhaust gas to pass through the cooling chamber 14 along the path indicated by arrow B. In the closed position the valve 70 closes the exhaust gas outlet chamber 12, forcing the exhaust gas to pass along the bypass tube 50 along the path indicated by arrow C. The motor 74 may be an electric motor, or a mechanically or hydraulically operated motor or switch.

The valve 70 is thus operated by means of the motor 74 to the open position to direct the recirculated portion of the exhaust gases to an intake line via the bypass tube 50 under low engine temperature and/or load operating conditions, in order to supply hot exhaust gases to the engine under low temperature conditions and during start-up of the engine in order to reduce condensation in the piping and cooler. As the engine heats up, the valve 70 is moved towards the closed position so that the recirculated portion of the exhaust gases is cooled and the cooler exhaust gases are directed to the engine.

The cooling chamber 14 and the exhaust gas inlet and outlet chambers 10, 12 are assembled in the usual way, and may be connected by furnace brazing. The valve 70 is susceptible to damage if subject to furnace brazing, so the bypass tube 50 is assembled separately and then connected to the cooling, inlet and outlet chambers 10, 12, 14 by welding or similar at two connection points 80, 82.

The valve 70 is provided at the outlet end, which is the cooler end of the apparatus, to increase the longevity of operation of the valve 70. However it is to be understood that the valve 70 may instead be provided at the inlet end, if the valve 70 is of such construction as to withstand the hotter exhaust gases. In this case, valve 70 remains at the third straight tubular portion 36 and functions as described above, except that the inlet 20 will be an outlet and the outlet 30 will be an inlet and so the the direction of flow of arrows A, B and C in FIGS. 1 to 4 is reversed.

The exhaust gas cooler may be made of any suitable material, for example steel, alloy or stainless steel, and is fabricated in the conventional manner using furnace brazing or similar. The valve 70 may be added after brazing to prevent heat damage to the actuating mechanism of the valve.

Modifications and improvements may be made to the embodiments without departing from the scope of the invention. For instance, the shape of the coolant chamber 14 may be other than that shown in the drawings. The chamber 14 may have an oval or rectangular cross-section. The exhaust gas inlet 10 and outlet 12 chambers may have shapes different to those shown in the drawings. The tapered sections may be replaced by step changes in cross-section. The elbow sections 22, 34 and bypass tube 50 may have different cross-sections, for example, circular, oval, or rectangular.

What is claimed is:

1. An exhaust gas cooler comprising:

an exhaust gas inlet chamber communicating with an exhaust gas inlet, an exhaust gas outlet chamber communicating with an exhaust gas outlet, a coolant chamber arranged between said exhaust gas inlet chamber and said exhaust gas outlet chamber and having a coolant inlet and a coolant outlet communicating with the coolant chamber, a plurality of exhaust gas passages inside the coolant chamber and communicating with the exhaust gas inlet chamber and exhaust gas outlet chamber, a mechanism to attach an exhaust gas bypass passage outside the coolant chamber to communicate with the exhaust gas inlet chamber and exhaust gas outlet chamber wherein the mechanism avoids contact between a wall of the bypass passage proximate to an exhaust gas outlet of the bypass passage and a wall of the coolant chamber proximate to the exhaust gas outlet chamber and wherein the exhaust gas bypass passage or the mechanism allows for expansion and contraction of the exhaust bypass passage; and a valve operable between the exhaust gas passages and exhaust gas outlet to adjust flow of exhaust gas to the exhaust gas outlet from the exhaust gas passages and the exhaust gas bypass passage.

2. An exhaust gas cooler as claimed in claim 1, wherein the mechanism to attach the bypass passage is integrally formed with the exhaust gas inlet chamber and the exhaust gas outlet chamber.

3. An exhaust gas cooler as claimed in claim 1, further comprising a motor adapted to drive the valve between an open position leaving the exhaust gas outlet chamber open and covering an outlet of the mechanism to attach the bypass passage and a closed position in which the valve closes the exhaust gas outlet chamber leaving the outlet of the mechanism to attach a bypass passage open.

4. An exhaust gas cooler as claimed in claim 1, wherein the coolant chamber is arranged axially parallel to the bypass passage when the bypass passage is attached.

5. An exhaust gas cooler as claimed in claim 1, wherein the mechanism to attach a bypass passage has a bypass inlet which communicates with the exhaust gas inlet chamber, the bypass inlet being arranged substantially perpendicular to the direction of flow of exhaust gas through the exhaust gas inlet chamber to the coolant chamber.

6. An exhaust gas cooler as claimed in claim 5, wherein the bypass passage comprises an elbow adjacent to the bypass inlet so that the bypass inlet is substantially perpendicular to the axis of the bypass passage when it is attached.

7. An exhaust gas cooler as claimed in claim 5, wherein the exhaust gas inlet chamber comprises an elbow portion between the coolant chamber and the bypass inlet.

8. An exhaust gas cooler as claimed in claim 1, wherein the mechanism to attach a bypass passage has an outlet which communicates with the exhaust gas outlet chamber, the bypass outlet being arranged substantially perpendicular to the direction of flow of exhaust gas through the exhaust gas outlet chamber from the coolant chamber.

9. An exhaust gas cooler as claimed in claim 8, wherein the exhaust gas outlet chamber comprises an elbow portion between the coolant chamber and the bypass outlet.

10. An exhaust gas cooler as claimed in claim 8, wherein the bypass passage comprises an elbow adjacent to the bypass outlet so that the bypass outlet is substantially perpendicular to the axis of the bypass passage.

11. An exhaust gas cooler as claimed in claim 1, wherein the bypass passage is formed integrally with the exhaust gas inlet chamber and the exhaust gas outlet chamber.

12. An exhaust gas cooler as claimed in claim 11, wherein the bypass passage includes an expansion mechanism to permit differential thermal expansion of the bypass passage and coolant chamber.

13. An exhaust gas cooler as claimed in claim 11, wherein the bypass passage includes a damping mechanism to assist in vibrational damping of the bypass passage.

14. An exhaust gas cooler as claimed in of claim 1, wherein the exhaust gas cooler can be provided without a bypass passage and the bypass passage is retro-fitted before use.

15. An exhaust gas cooler as claimed in claim 1, wherein the coolant chamber is a tubular chamber.

16. An exhaust gas cooler as claimed in claim 1, wherein the exhaust gas passages are exhaust gas tubes.

17. An exhaust gas cooler as claimed in claim 1, wherein the bypass passage is a bypass tube.

* * * * *